US006142851A

United States Patent [19]

Lewinski et al.

[11] Patent Number: 6,142,851

[45] Date of Patent: Nov. 7, 2000

[54] TOY WITH MOTION TRANSMITTING ELEMENTS

[75] Inventors: David P. Lewinski; David W. Dewar, both of Cincinnati, Ohio

[73] Assignee: Hasbro, Inc., Pawtucket, R.I.

[21] Appl. No.: 09/048,250

[22] Filed: Mar. 26, 1998

[51] Int. Cl.[7] ..... A63H 11/12

[52] U.S. Cl. ..... 446/278; 446/330; 446/334; 446/340

[58] Field of Search ..... 446/330, 334, 446/340, 83, 379, 381, 383, 368, 425, 426, 454, 278; 403/55, 56, 81, 180; 74/502.1; 248/481, 484, 485; 359/873, 875; 273/447, 448

[56] References Cited

U.S. PATENT DOCUMENTS

| | | | |
|---|---|---|---|
| 270,705 | 1/1883 | Tumey . | |
| 1,528,840 | 3/1925 | Muller . | |
| 2,038,460 | 4/1936 | Weiss . | |
| 2,158,860 | 5/1939 | Hyde . | |
| 2,194,537 | 3/1940 | Adams . | |
| 2,940,607 | 6/1960 | Bonanno . | |
| 3,017,718 | 1/1962 | Estes . | |
| 3,104,015 | 9/1963 | Goldfarb . | |
| 3,477,171 | 11/1969 | Bonanno | 446/330 |
| 3,566,535 | 3/1971 | Handler et al. | 446/381 |
| 3,888,563 | 6/1975 | Dierkes | 359/405 |
| 3,911,613 | 10/1975 | Morrison et al. . | |
| 3,911,615 | 10/1975 | Alexander . | |
| 4,188,746 | 2/1980 | Wolf . | |
| 4,412,682 | 11/1983 | Rehkemper et al. . | |
| 4,526,552 | 7/1985 | Rhodes . | |
| 4,783,161 | 11/1988 | Shamoto | 248/479 |
| 4,863,164 | 9/1989 | Mizunuma | 273/447 |
| 4,867,730 | 9/1989 | Lee . | |
| 4,881,282 | 11/1989 | George et al. | 4/604 |
| 4,889,308 | 12/1989 | Gillet | 248/485 |
| 4,941,639 | 7/1990 | Sakao | 248/549 |
| 4,981,279 | 1/1991 | Andreas et al. | 248/483 |
| 5,324,225 | 6/1994 | Satoh et al. . | |
| 5,397,134 | 3/1995 | Fishman et al. | 273/448 |
| 5,549,372 | 8/1996 | Lewis | 312/114 |
| 5,855,374 | 1/1999 | Shoemaker, Jr. | 273/447 |

FOREIGN PATENT DOCUMENTS

| | | | |
|---|---|---|---|
| 737601 | 12/1932 | France | 446/353 |
| 664441 | 1/1952 | United Kingdom . | |

*Primary Examiner*—Sam Rimell
*Attorney, Agent, or Firm*—Fish & Richardson P.C.

[57] ABSTRACT

A toy includes a first pivot joint, a second pivot joint, a first shaft held by the first pivot joint such that the first shaft can pivot in any direction, a second shaft held in the second pivot joint such that the second shaft can pivot in any direction, and a coupling between the first shaft and the second shaft configured such that motion applied to one shaft produces a mirrored motion in the other shaft. The toy may be configured to have the appearance of a dinosaur such as triceratops.

20 Claims, 4 Drawing Sheets

105
115
110

105
110
115

115
105
110

105
115
110

115
105
110

105
115
110

105
115
110

TOY WITH MOTION TRANSMITTING ELEMENTS

BACKGROUND

The invention relates to toys, in particular to toys with moveable parts.

SUMMARY

In general, in one aspect, a toy includes a first pivot joint, a second pivot joint, a first shaft held by the first pivot joint such that the first shaft can pivot in any direction, a second shaft held in the second pivot joint such that the second shaft can pivot in any direction, and a coupling between the shafts configured such that motion applied to one shaft produces a mirrored motion in the other.

Embodiments of the toy may include the following features. The shafts may be configured to pivot up, down, left, and right, or even rotationally within their respective pivot joints. The pivot joints may be ball and socket joints.

The coupling between shafts may include a coiled spring. The coupling may additionally include an arm and sleeve assembly extending from one end of the coiled spring to an end of the first shaft, while an opposite end of the spring is connected to an end of the second shaft, thereby permitting only linear motion of the arm within the sleeve.

A head may encase the first shaft and the tail the second shaft. The toy may be configured to present the appearance of a dinosaur such as a triceratops. The toy also may be in the form of, for example, an action figure, a doll, an animal, a fanciful creature, or a toy vehicle. When the toy is in the form of a doll, the coupling may be configured, for example, to move the doll's head in response to movement of the doll's toe. When the toy is in the form of a vehicle, such as a bulldozer or a crane, the coupling may be configured so that movement of a handle at one end of the toy causes movement of a component at another end of the toy.

In general, in another embodiment, a toy figure includes a head, a tail, a head joint, a tail joint, a head shaft encased by the head such that the head shaft moves with the head, the head shaft being held by the head joint such that the head shaft can be pivoted or rotated within the head joint, a tail shaft encased by the tail such that the tail shaft moves with the tail, the tail shaft being held by the tail joint such that the tail shaft can be pivoted or rotated within the tail joint, and a coupling between the head shaft and the tail shaft constructed such that directional and rotational motion applied to the tail is mirrored by direction and rotational motion of the head.

Advantages may include one or more of the following.

The mirrored motion of toy parts enables children to quickly learn how to manipulate the toy to produce realistic animal movements. Further, the freedom of movement of the different shafts in their respective joints enables the toy to mimic a wide variety of animal behavior.

Other features and advantages will be apparent from the following detailed description, including the drawings, and from the claims.

DRAWING DESCRIPTION

FIGS. 5*a*–5*g* are block diagrams illustrating the effect that moving one end of the toy has upon the other end.

DETAILED DESCRIPTION

Figure 1:
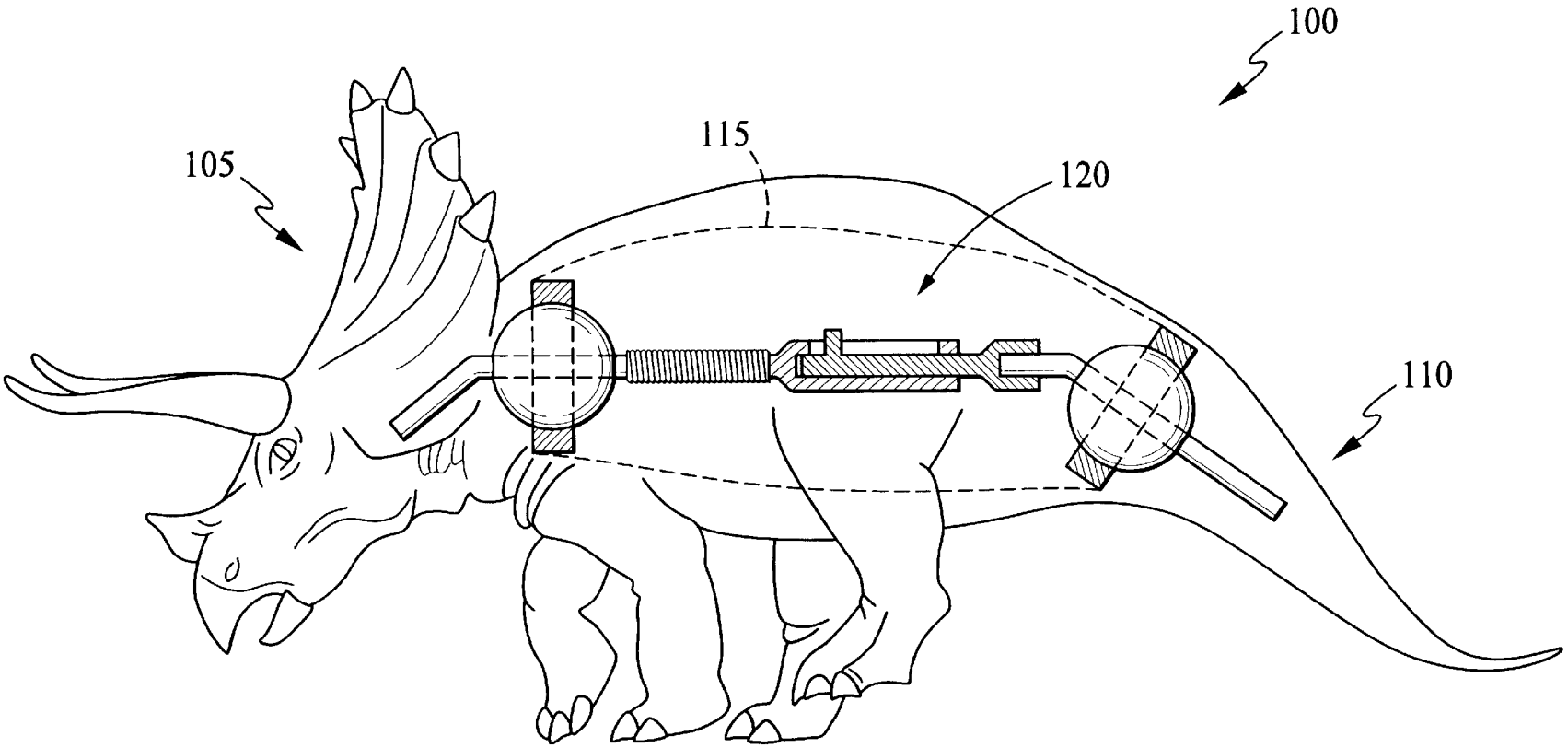
FIG. 1 is a diagram of a play action toy with a movable head and tail.

Referring to FIG. 1, a play action toy 100 includes an exterior that can assume a variety of appearances. For example, as shown in FIG. 1, the toy may be made to resemble a dinosaur such as a triceratops. The toy 100 includes a free-moving head 105 and tail 110. An interior cage 115 in the toy encases parts 120 that connect the head 105 to the tail 110. The parts 120 connect the head 105 and tail 110 such that a directional (up, down, left, right, and combinations thereof) or rotational (clockwise, counter-clockwise) motion imparted to one of them produces a mirrored motion of the other. For example, lifting the tail 110 moves the head 105 upward. Thus, the tail can be manipulated to produce different head motions imitative of animal behaviors such as grazing or fighting.

Figure 2:
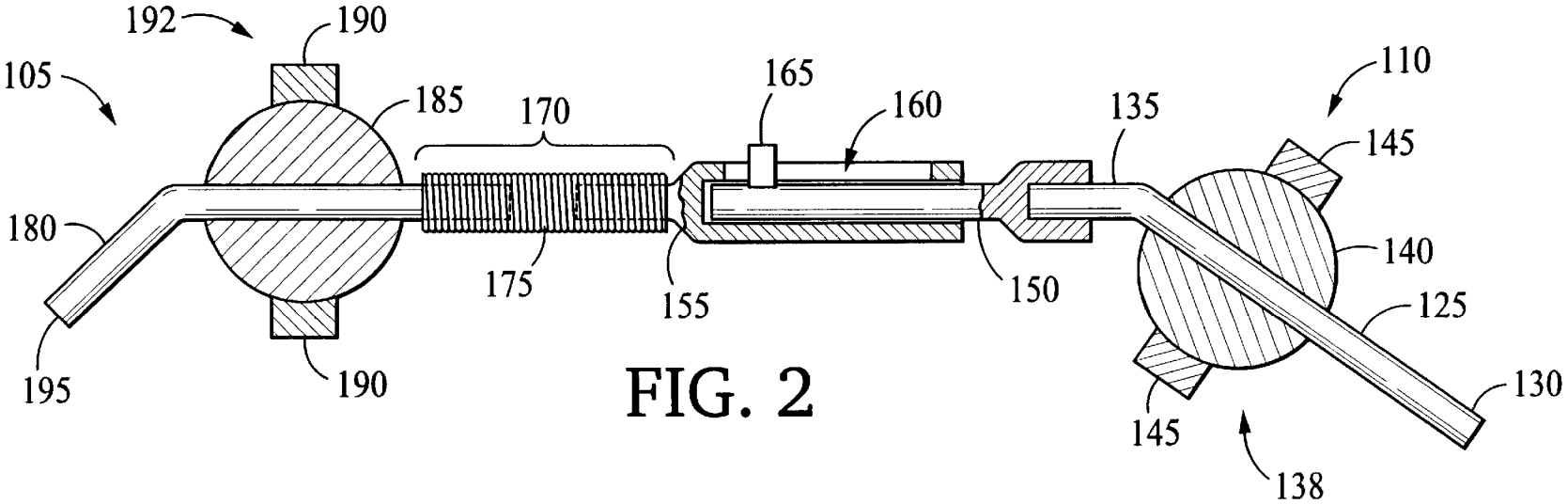
FIG. 2 is a diagram of moving parts included in the toy of FIG. 1.
Figure 3:
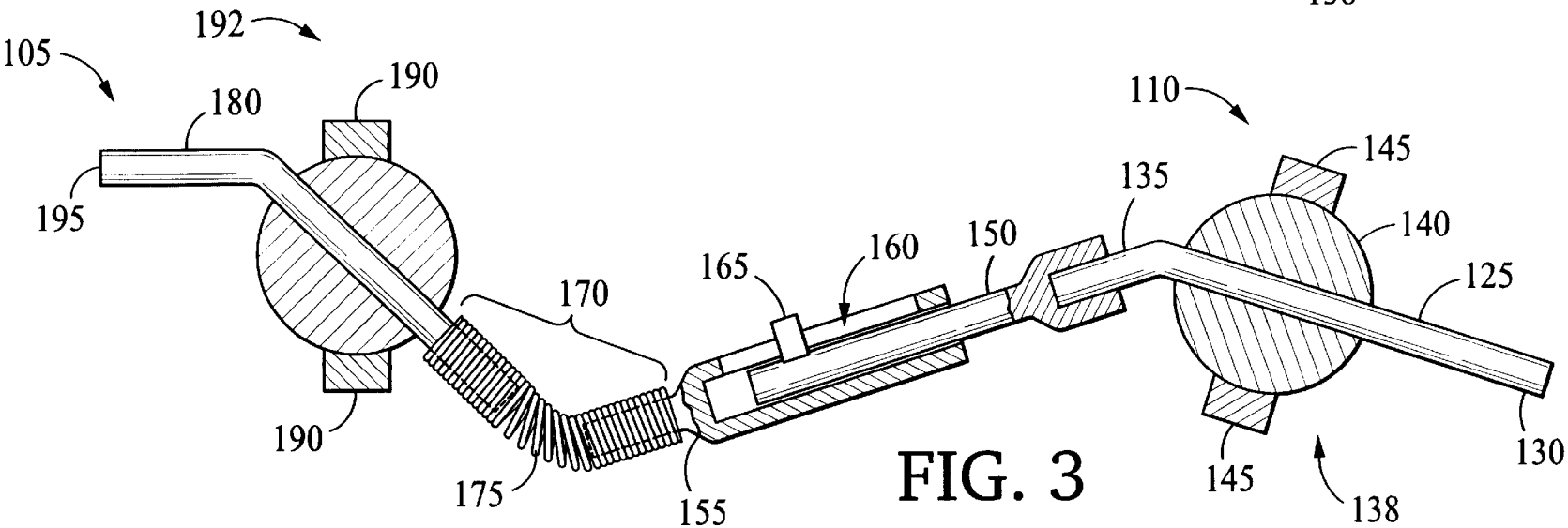
FIG. 3 is a diagram of the moving parts of FIG. 2 after moving one end of the toy.

Referring to FIGS. 2 and 3, the tail 110 includes a tail shaft 125 having ends 130 and 135 and extending through either side of a ball and socket joint 138 that includes a movable ball 140 and a stationary socket 145. The ball and socket joint 138 acts as a fulcrum between the ends of the tail-shaft 125 such that directional motion applied to one end of the tail shaft 125 produces an opposite movement in the other end. For example, lifting tail-shaft end 130 causes the other end 135 of the tail-shaft to drop. The ball and socket joint 138 also permits rotation of the tail-shaft 125. Rotation of the tail-shaft 125 causes the ball 140 to correspondingly rotate within the socket 145.

Figure 4:
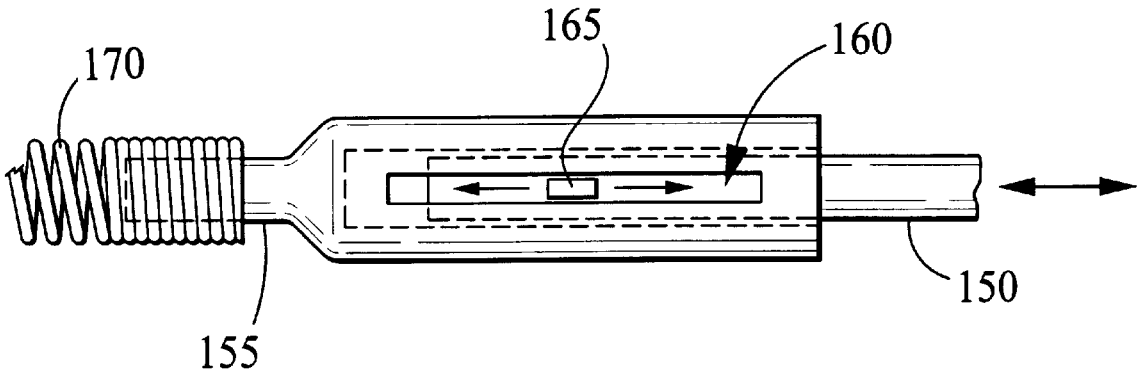
FIG. 4 is a diagram of an arm and sleeve assembly included in the moving parts of FIG. 2.

Referring also to FIG. 4, the tail shaft 125 connects to an arm 150 secured within a sleeve 155 by a slot 160 in the sleeve 155 that holds a peg 165 extending from the arm 150. The slot 160 allows the arm 150 to move linearly within the sleeve 155 to extend or contract the length of the arm/sleeve assembly 150 and 155. Rotation of the arm 150 caused by rotation of the tail-shaft 125 does not cause the arm to rotate within the sleeve 155. Rather rotation of the arm 150 also rotates the sleeve 155.

A spring 170 connects the sleeve 155 with an end 175 of a head-shaft 180. Like the tail-shaft 125, the head shaft 180 extends through a movable ball 185 positioned in a stationary socket 190 to form a ball and socket joint 192. The ball and socket joint 192 acts as a fulcrum between the ends 175 and 195 of the head-shaft 180. The spring 170 pulls the connected head-shaft end 175 in the same direction as the sleeve 155 moves. Thus, if sleeve 155 moves downward (as shown in FIG. 3), the end 175 of the head-shaft 180 also moves down. The directional motion of the connected head-shaft end 175 moves the ball 185 within the socket 190 and causes an opposite motion in the other end 195 of the head-shaft 180 (e.g., if end 175 moves down, end 195 moves up). The spring 170 may also pull the sleeve 155 and increase the length of the arm/sleeve assembly. The increase in length of the arm/sleeve assembly eases movement since changing the length requires less effort than stretching the spring 170. The spring 170 also transmits rotational motion of the sleeve 155 caused by rotation of the tail-shaft 125 to the head-shaft 180, so as to cause the head-shaft ball 185 to rotate within the head-shaft socket 190.

Referring to FIG. 3, lifting the tail 110 above the level shown in FIG. 2 causes the head 105 to similarly lift. To briefly recount the interaction of parts that produces this effect, lifting the tail 110 lifts the free end 130 of the tail-shaft 125. This causes ball 140 to rotate counter-clockwise in socket 145 and the opposite end 135 of the tail-shaft 125 to move down. This motion also depresses the arm 150 and sleeve 155. The spring 170, pulled down by the arm 150 and sleeve 155 pulls down one end 175 of the head-shaft 180. This causes ball 185 to rotate clockwise in socket 190, thus lifting the other end 195 of the head-shaft 180.

Figures 5, 5A, 5B, 5C, 5D, 5E, 5F, 5G:
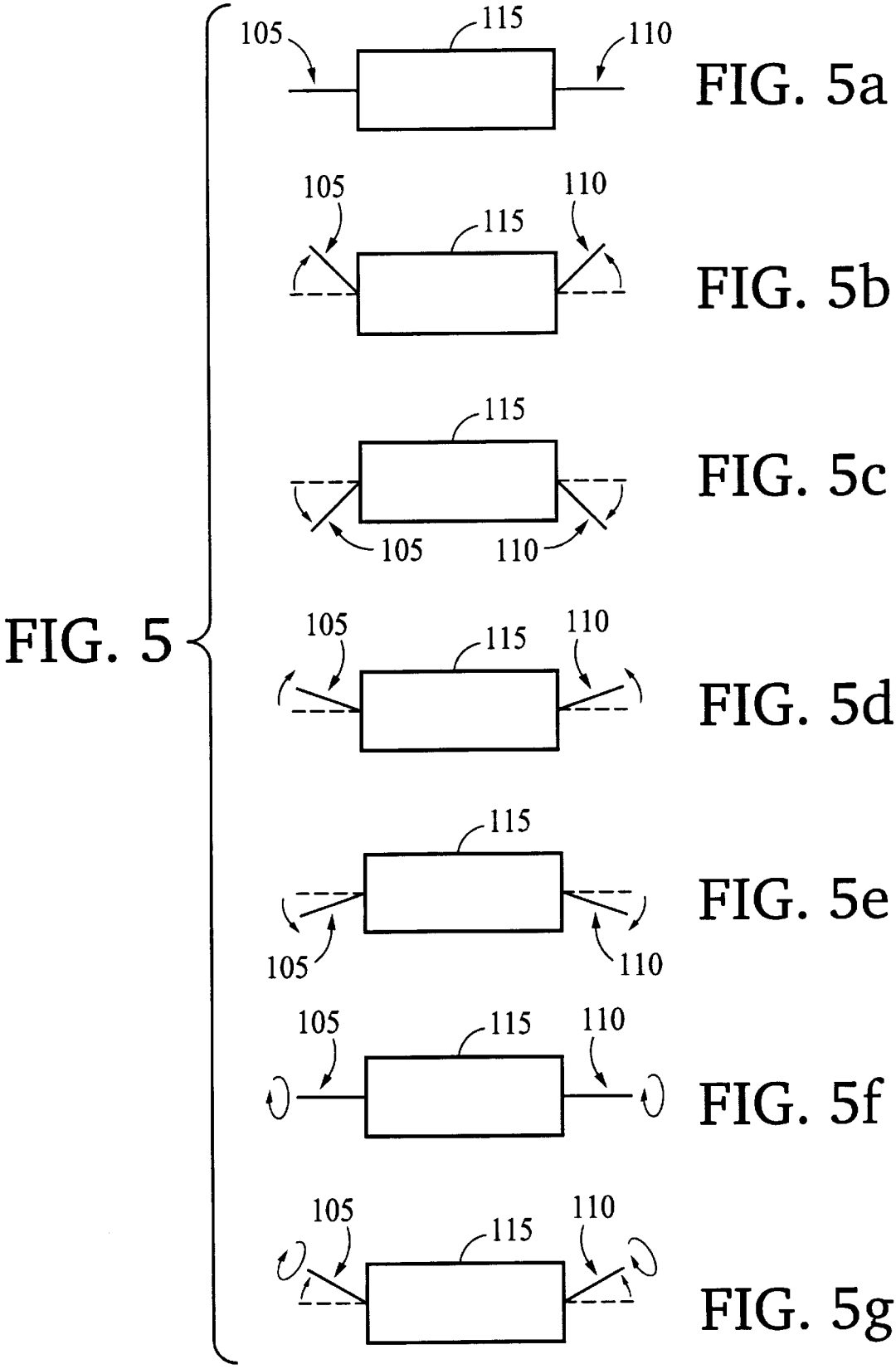

Referring to FIGS. 5*a*–5*g*, directional movement of the tail 110 causes mirrored directional movement of the head 105. Directional movements include up (FIG. 5*b*), down (FIG. 5*c*), and lateral (FIGS. 5*d* and 5*e*) motions. Rotation of the tail 110 also causes substantially identical rotation of the head 105 (FIG. 5*f*). Any combination of directional and rotations movements of the tail 110 will also be simultaneously transmitted to the opposite end 105. For example, in FIG. 5*g*, rotating and moving the tail up and to the left causes a similar action in the head.

Other embodiments are within the scope of the following claims.

What is claimed is:

1. A toy figure comprising:

a toy figure body; having two movable members extending therefrom a first pivot joint carried by the toy figure body;

a second pivot joint carried by the toy figure body;

a first shaft within said second movable member held by the first pivot joint such that the first shaft can pivot about the first pivot joint;

a second shaft within said second movable member held in the second pivot joint such that the second shaft can pivot about the second pivot joint; and a coupling between the first shaft and the second shaft extending through said toy figure body, the coupling being configured such that pivoting one of the shafts and movable member in a first direction about the shaft's respective pivot joint causes a pivoting of the other shaft and movable member in the first direction.

2. The toy of claim 1 wherein the first and second shafts are configured to pivot up, down, left, and right within their respective pivot joints.

3. The toy of claim 1 wherein the first and second shafts are configured to move rotationally within their respective pivot joints.

4. The toy of claim 1 wherein the pivot joints comprise ball and socket joints.

5. The toy of claim 1 wherein the coupling comprises a coiled spring.

6. The toy of claim 5 wherein the coupling comprises an arm and sleeve assembly extending from one end of the spring to an end of the first shaft, wherein an opposite end of the spring is connected to an end of the second shaft and the assembly is configured to permit only linear motion of the arm within the sleeve.

7. The toy of claim 1 wherein the toy figure body comprises a movable head that encases the first shaft and a movable tail that encases the second shaft.

8. The toy of claim 1 wherein the toy figure body is configured to have the appearance of a dinosaur.

9. The toy of claim 8 wherein the toy figure body is configured to have the appearance of a triceratops.

10. A toy figure, comprising:

a toy figure body having a head and a tail;

a head joint carried by the toy figure body;

a tail joint carried by the toy figure body;

a head shaft encased by the head such that the head shaft moves with the head, the head shaft being held by the head joint such that the head shaft can be pivoted and rotated within the head joint;

a tail shaft encased by the tail such that the tail shaft moves with the tail, the tail shaft being held by the tail joint such that the tail shaft can be pivoted and rotated within the tail joint; and a coupling between the head shaft and the tail shaft constructed such that pivoting and rotational motion applied to the tail in a first direction causes pivoting and rotational motion of the head in the first direction.

11. The toy figure of claim 10 wherein the coupling comprises a coiled spring.

12. The toy figure of claim 11 wherein the coupling comprises an arm and sleeve assembly extending from one end of the spring to an end of the first shaft, wherein an opposite end of the spring is connected to an end of the second shaft and the assembly is configured to permit only linear motion of the arm within the sleeve.

13. The toy figure of claim 10 wherein the toy figure body is configured to have the appearance of a dinosaur.

14. The toy figure of claim 13 wherein the toy figure body is configured to have the appearance of a triceratops.

15. A toy figure comprising:

a toy figure body;

a first ball and socket joint carried by the toy figure body;

a second ball and socket joint carried by the toy figure body;

a first shaft held by the first ball and socket joint such that the first shaft can pivot in any direction;

a second shaft held in the second ball and socket joint such that the second shaft can pivot in any direction; and a coupling between the first shaft and the second shaft, the coupling being configured such that pivoting one of the shafts in a first direction causes a pivoting of the other shaft in the first direction.

16. The toy of claim 15 wherein the first and second shafts are configured to move rotationally within their respective ball and socket joints and wherein rotating one of the shafts causes a similar rotation in the other one of the shafts.

17. The toy of claim 15 wherein the toy figure body is configured to have the appearance of an animal.

18. A toy figure comprising:

a toy figure body;

a first pivot joint carried by the toy figure body;

a second pivot joint carried by the toy figure body;

a first shaft held by the first pivot joint such that the first shaft can pivot in any direction;

a second shaft held in the second pivot joint such that the second shaft can pivot in any direction; and a coiled wire coupling between the first shaft and the second shaft, the coupling being configured such that pivoting one of the shafts in a first direction causes a pivoting of the other shaft in the other direction.

19. The toy of claim 18 wherein the first and second shafts are configured to move rotationally within their respective pivot joints and wherein rotating one of the shafts causes a similar rotation of the other one of the shafts.

20. The toy of claim 18 wherein the toy figure body is configured to have the appearance of an animal.

* * * * *